US005362555A

United States Patent [19]

Lal

[11] Patent Number: 5,362,555

[45] Date of Patent: Nov. 8, 1994

[54] COMPOSITIONS AND POLYMER FABRICS TREATED WITH THE SAME

[76] Inventor: Kasturi Lal, 2993 Nantucket Dr., Willoughby, Ohio 44094

[21] Appl. No.: 217,400

[22] Filed: Mar. 24, 1994

Related U.S. Application Data

[62] Division of Ser. No. 771,682, Oct. 4, 1991, Pat. No. 5,321,098.

[51] Int. Cl.[5] ..... B32B 27/00

[52] U.S. Cl. ..... 428/290; 428/289; 604/358

[58] Field of Search ..... 428/288, 290, 289; 604/358

[56] References Cited

U.S. PATENT DOCUMENTS

| | | | |
|---|---|---|---|
| 2,444,328 | 6/1948 | Blair, Jr. | 260/404.3 |
| 2,482,760 | 9/1949 | Goebel | 260/419 |
| 2,482,761 | 9/1949 | Goebel | 260/407 |
| 2,731,481 | 1/1956 | Harrison et al. | 260/407 |
| 2,793,219 | 5/1957 | Barrett et al. | 260/407 |
| 2,964,545 | 12/1960 | Harrison | 260/407 |
| 2,978,463 | 4/1961 | Kuester et al. | 260/348 |
| 3,157,681 | 11/1964 | Fischer | 260/407 |
| 3,215,707 | 11/1965 | Reuse | 260/326.3 |
| 3,219,666 | 11/1965 | Norman et al. | 260/268 |
| 3,231,587 | 1/1966 | Reuse | 260/346.8 |
| 3,256,304 | 6/1966 | Fischer et al. | 260/407 |
| 3,329,608 | 7/1967 | Hiestand . | |
| 3,412,111 | 11/1968 | Irwin et al. | 260/346.8 |
| 4,094,796 | 6/1978 | Schwartz . | |
| 4,108,889 | 8/1978 | Connor | 260/382.4 |
| 4,110,349 | 8/1978 | Cohen | 260/346.74 |
| 4,234,435 | 11/1980 | Meinhardt | 252/51.5 |

FOREIGN PATENT DOCUMENTS

| | | |
|---|---|---|
| WO9114040 | 9/1991 | WIPO . |
| WO9114041 | 9/1991 | WIPO . |

OTHER PUBLICATIONS

"The Eve Reaction of Moleic Anhydride with Alkenes", Beua et al., JCS 1977, pp. 533–535.

*Primary Examiner*—James J. Bell
*Attorney, Agent, or Firm*—David M. Shold

[57] ABSTRACT

The invention relates to a composition mixture comprising (i) at least one ester-acid, ester-salt or mixtures thereof and (ii) at least one amidic-acid, amidic-salt or mixtures thereof a polymer fabrics treated with the same. The treated polymer fabrics have improved wicking/wetting characteristics. The treated polymer fabrics maintain these characteristics upon repeated exposure to aqueous fluids.

5 Claims, No Drawings

COMPOSITIONS AND POLYMER FABRICS TREATED WITH THE SAME

This is a divisional of copending application Ser. No. 07/771,682 filed on Oct. 4, 1991, now U.S. Pat. No. 5,321,098.

FIELD OF THE INVENTION

This invention relates to compositions and treated polymer fabrics.

BACKGROUND OF THE INVENTION

Polymer fabrics are extensively used in a wide variety of products, ranging from disposable towel sheets to sanitary napkins and from disposable diapers to surgical sponges. All these applications involve the absorption of water or aqueous liquids (urine, blood, lymph, spills of coffee, tea, milk, etc.). The fabrics must have good wicking properties, i.e., water must be readily taken up and spread.

Polymer fabrics are generally hydrophobic. It is desirable to improve the wicking/wetting ability of the polymer fabrics. Often wetting agents are used to improve the ability of the polymer fabric to pass water and bodily fluids through the polymer fabric and into an absorbent layer. Further, it is desirable that the polymer fabric maintain its wicking/wetting characteristics after repeated exposure to water or aqueous liquids.

SUMMARY OF THE INVENTION

This invention relates to a composition comprising: (i) at least one ester-acid, ester-salt or mixtures thereof and (ii) at least one amidic-acid, amidic-salt or mixtures thereof. These compositions are useful in treating polymer fabrics. The treated polymer fabrics have improved wicking/wetting characteristics. The treated polymer fabrics maintain these characteristics upon repeated exposure to aqueous fluids.

DESCRIPTION OF THE PREFERRED EMBODIMENTS

The term "hydrocarbyl" includes hydrocarbon, as well as substantially hydrocarbon, groups. Substantially hydrocarbon describes groups which contain non-hydrocarbon substituents which do not alter the predominately hydrocarbon nature of the group.

Examples of hydrocarbyl groups include the following:

(1) hydrocarbon substituents, that is, aliphatic (e.g., alkyl or alkenyl), alicyclic (e.g., cycloalkyl, cycloalkenyl) substituents, aromatic-substituted aliphatic substitutents or aromatic-substituted alicyclic substituents, or, aliphatic- and alicyclic-substituted aromatic substituents and the like as well as cyclic substituents wherein the ring is completed through another portion of the molecule (that is, for example, any two indicated substituents may together form an alicyclic radical);

(2) substituted hydrocarbon substituents, that is, those substituents containing non-hydrocarbon groups which, in the context of this invention, do not alter the predominantly hydrocarbon substituent; those skilled in the art will be aware of such groups (e.g., halo (especially chloro and fluoro), hydroxy, alkoxy, mercapto, alkylthio, nitro, nitroso, sulfoxy, etc.);

(3) hetero substituents, that is, substituents which will, while having a predominantly hydrocarbon character within the context of this invention, contain other than carbon present in a ring or chain otherwise composed of carbon atoms. Suitable heteroatoms will be apparent to those of ordinary skill in the art and include, for example, sulfur, oxygen, nitrogen and such substituents as, e.g., pyridyl, furyl, thienyl, imidazolyl, etc. In general, no more than about 2, preferably no more than one, non-hydrocarbon substituent will be present for every ten carbon atoms in the hydrocarbyl group. Typically, there will be no such non-hydrocarbon substituents in the hydrocarbyl group. In one embodiment, the hydrocarbyl group is purely hydrocarbon.

(A) Polymer Fabrics

The polymer fabrics which are treated in accordance with this invention may be any polymer fabric, preferably a woven or nonwoven fabric, more preferably a nonwoven fabric. The polymer fabric may be prepared by any method known to those skilled in the art. When the fabric is nonwoven, it may be a spunbonded or melt-blown polymer fabric, preferably a spunbonded fabric. Spinbonding and melt-blowing processes are known to those in the art.

The polymer fabric may be prepared from any thermoplastic polymer. The thermoplastic polymer can be a polyester, polyamide, polyurethane, polyacrylic, polyolefin, combinations thereof, and the like. The preferred material is polyolefin.

The polyolefins are polymers which are essentially hydrocarbon in nature. They are generally prepared from unsaturated hydrocarbon monomers. However, the polyolefin may include other monomers provided the polyolefin retains its hydrocarbon nature. Examples of other monomers include vinyl chloride, vinyl acetate, methacrylic or acrylic acids or esters, acrylamides and acrylonitriles. Preferably, the polyolefins are hydrocarbon polymers. The polyolefins include homopolymers, copolymers and polymer blends.

Copolymers can be random or block copolymers of two or more olefins. Polymer blends can utilize two or more polyolefins or one or more polyolefins and one or more nonpolyolefin polymers. As a practical matter, homopolymers and copolymers and polymer blends involving only polyolefins are preferred, with homopolymers being most preferred.

Examples of polyolefins include polyethylene, polystyrene, polypropylene, poly(1-butene), poly(2-butene), poly(1-pentene), poly(2-pentene), poly(3-methyl-1-pentene), poly(4-methyl-1-pentene), poly-1,3-butadiene and polyisoprene or these hydrogenated analogs, more preferably polyethylene and polypropylene.

(B) The Mixtures

The polymer fabric is treated with at least one mixture comprising (i) an ester-acid, ester-salt or mixtures thereof, and (ii) an amidic-acid, amidic-salt or mixtures thereof to improve the hydrophilic character of the fabric. The treated polymer fabrics have improved wetting and wicking properties. The ester-acid has at least one ester group and at least one acid group while the ester-salt has at least one ester group and one salt group. The amidic-acid has an amide group and an acid group while the amidic-salt has an amide group and a salt group. The ester-acid, ester-salt and mixtures thereof are prepared by reacting a polycarboxylic acylating agent with a polyhydroxy compound. The polycarboxylic acylating agent may be an acid, anhydride, ester or acid chloride. The amidic-acid, amidic-salt or mixtures thereof is prepared by reacting a polycarboxylic acylating agent with an amine selected from secondary alkyl amines, amine-terminated polyoxyalkylenes, and tertiary alkyl primary amines under amide forming conditions.

The polycarboxylic acylating agents include di- and tricarboxylic acylating agents. Polycarboxylic acylating agents include dimer acid acylating agents, hydrocarbyl-substituted succinic acylating agents, Alder acylating agents, and trimer acid acylating agents, preferably hydrocarbyl-substituted succinic acylating agents.

The dimer acylating agents are the products resulting from the dimerization of unsaturated fatty acids. Generally, the dimer acylating agents have an average from about 18, preferably about 28 to about 44, preferably to about 40 carbon atoms. In one embodiment, the dimer acylating agents have preferably about 36 carbon atoms. The dimer acylating agents are preferably prepared from fatty acids. Fatty acids generally contain from 8, preferably about 10, more preferably about 12 to 30, preferably to about 24 carbon atoms. Examples of fatty acids include oleic, linoleic, linolenic, tall oil and rosin acids, preferably oleic acid. e.g., the above-described fatty acids. The dimer acylating agents are described in U.S. Pat. Nos. 2,482,760; 2,482,761; 2,731,481; 2,793,219; 2,964,545; 2,978,463; 3,157,681 and 3,256,304, the entire disclosures of which are incorporated herein by reference. Examples of dimer acylating agents include Empol® 1041, 1016 and 1018 Dimer Acid, each available from Emery Industries, Inc. and Hystrene® dimer acids 3675, 3680, 3687 and 3695, available from Humko Chemical.

In another embodiment, the polycarboxylic acylating agents are dicarboxylic acylating agents which are prepared by reacting an unsaturated fatty acid (e.g., the above-described fatty acids, preferably tall oil acids or oleic acids) with alpha, beta-ethylenically unsaturated carboxylic acylating agent (e.g., acrylic or methacrylic acylating agents). This reaction is known as the "Ene" reaction or the Alder reaction. The acylating agents made by this reaction are referred to herein as Alder acylating agents. In U.S. Pat. No. 2,444,328, the disclosure of which is incorporated herein by reference. These Alder acylating agents include Westvaco® Diacid H-240, 1525 and 1550, each being commercially available from the Westvaco Corporation.

In a preferred embodiment the polycarboxylic acylating agents are hydrocarbyl-substituted succinic agents. The hydrocarbyl group has from about 8, preferably about 10, more preferably about 12 to about 150, more preferably to about 100, more preferably to about 50 carbon atoms. In one embodiment, the hydrocarbyl group contains from about 8, preferably about 10, more preferably about 12 to about 30, preferably to about 24, more preferably to about 18 carbon atoms. Preferably, the hydrocarbyl group is an alkyl group, an alkenyl group, a group derived from a polyalkene or mixtures thereof, more preferably an alkyl or alkenyl group. In one embodiment, the hydrocarbyl group may be an octyl, decyl, dodecyl, tridecyl, tetradecyl, hexadecyl, octadecyl, octenyl, decenyl, dodecenyl, tetradecenyl, hexadecenyl, octadecenyl, oleyl, tallow, soya or tetrapropenyl group.

In one embodiment the hydrocarbyl group is derived from olefins having from about 2 to about 30 carbon atoms or oligomers thereof. These olefins are preferably alpha-olefins (sometimes referred to as mono-1-olefins) or isomerized alpha-olefins. Examples of the alpha-olefins include 1-octene, 1-nonene, 1-decene, 1-dodecene, 1-tridecene, 1-tetradecene, 1-pentadecene, 1-hexadecene, 1-heptadecene, 1-octadecene, 1-nonadecene, 1-eicosene, 1-henicosene, 1-docosene, 1-tetraconsene, etc. Commercially available alpha-olefin fractions that can be used include the $C_{15-18}$ alpha-olefins, $C_{12-16}$ alpha-olefins, $C_{14-16}$ alpha-olefins, $C_{14-18}$ alpha-olefins, $C_{16-18}$ alpha-olefins, $C_{16-20}$ alpha-olefins, $C_{22-28}$ alpha-olefins, etc. The $C_{12}$ and $C_{16-18}$ alpha-olefins are particularly preferred.

Isomerized alpha-olefins may also be used to form Alder reaction products. These olefins are alpha-olefins that have been converted to internal olefins. The isomerized alpha-olefins suitable for use herein are usually in the form of mixtures of internal olefins with some alpha-olefins present. The procedures for isomerizing alpha-olefins are well known to those in the art. Briefly these procedures involve contacting alpha-olefins with a cation exchange resin at a temperature in a range of about 80° to about 130° C. until the desired degree of isomerization is achieved. These procedures are described for example in U.S. Pat. No. 4,108,889 which is incorporated herein by reference.

The hydrocarbyl group may also be derived from an oligomer of one or more of the above olefins. The oligomers are generally prepared from olefins having less than 7 carbon atoms, preferably ethylene, propylene or butylene, more preferably propylene. When the hydrocarbyl group is derived from an oligomer, the oligomer usually has from about 8 to about 30 carbon atoms. A preferred oligomer group has 12 carbon atoms and is a propylene tetramer. The hydrocarbyl group may be derived from mixtures of monoolefins.

When the hydrocarbyl group on the carboxylic acylating agent is derived from a polyalkene, the polyalkene has a number average molecular weight (Mn) from about 400, preferably about 700, more preferably about 800 to about 1500, preferably about 1200. The polyalkene is a homopolymer or an interpolymer of polymerizable olefin monomers of 2 to about 16 carbon atoms, preferably 2 to about 6 carbon atoms, more preferably 3 to 4 carbon atoms. The interpolymers are those in which 2 or more olefin monomers are interpolymerized according to well known conventional procedures to form polyalkenes. The monoolefins are preferably ethylene, propylene, butylene, or octylene with butylene preferred. A preferred polyalkene group is a polybutenyl group. Polyalkene groups and succinic acylating agents derived therefrom are disclosed in U.S. Pat. Nos. 3,215,707 (Rense); 3,219,666 (Norman et al); 3,231,587 (Rense); 4,110,349 (Cohen); and 4,234,435 (Meinhardt et al). These patents are incorporated by reference for its disclosure of polyalkene groups, succinic acylating agents as well as procedures for making either of the same.

The succinic acylating agents are prepared by reacting the above-described olefins or isomerized olefins with unsaturated carboxylic acids such as fumaric acids or maleic acid or anhydride at a temperature of about 160° to about 240° C., preferably about 185° to about 210° C. Free radical inhibitors (e.g., t-butyl catechol) may be used to reduce or prevent the formation of polymeric byproducts. The procedures for preparing the acylating agents are well known to those skilled in the art and have been described for example in U.S. Pat. No. 3,412,111; and Ben et al, "The Ene Reaction of Maleic Anhydride With Alkenes", J. C. S. Perkin II (1977), pages 535–537. These references are incorporated by reference for their disclosure of procedures for making the above acylating agents.

The polycarboxylic acylating agent may also be a tricarboxylic acylating agent. Examples of tricarboxylic acylating agents include trimer acid and Alder tricarboxylic acylating agents. These acylating agents generally contain an average from about 18, preferably about 30, more from about 36 to about 66, preferably to about 60 carbon atoms. Trimer acylating agents are prepared by the trimerization of the above-described fatty acids. The Alder tricarboxylic acylating agents are prepared by reacting an unsaturated monocarboxylic acid with alpha, beta-ethylenically unsaturated dicarboxylic acid (e.g., fumaric acid or maleic acid or anhydride). In one embodiment, the Alder acylating agent contains an average from about 12, preferably about 18 to about 40, preferably to about 30 carbon atoms. Examples of these tricarboxylic acylating agents include Empol® 1040 available commercially from Emery Industries, Hystrene® 5460 available commercially from Humko Chemical, and Unidyme® 60 available commercially from Union Camp Corporation.

In one embodiment, polyalkene substituted carboxylic acids may be used in combination with the fatty alkyl or alkenyl substituted carboxylic acids. The fatty alkyl or alkenyl groups are those having from about 8 to about 30 carbon atoms. It is preferred that the polyalkene substituted carboxylic acids and the fatty substituted carboxylic acids are used in mixtures of an equivalent ratio of from about (0–1.5:1), more preferably about (0.5–1:1), more preferably about (1:1).

The above polycarboxylic acylating agents are reacted with a hydroxy compound to form the ester-acids of the present invention. The hydroxy compounds may be polyhydric alcohols, hydroxyamines and hydroxy-containing polyoxyalkylene compounds. The hydroxy compounds include aliphatic or alkylenepolyols, polyoxyalkylene polyols, alkyl-terminated polyoxyalkylene polyols, polyoxyalkylene amines, polyoxyalkylated phenols, polyoxyalkylated fatty acids, polyoxyalkylated fatty amides, and alkanolamines.

In one embodiment, the hydroxy compounds include polyhydric alcohols, such as alkylene polyols. Preferably, these polyhydric alcohols contain from 2 to about 40, more preferably to about 20 carbon atoms; and from 2 to about 10, more preferably to about 6 hydroxyl groups. Polyhydric alcohols include ethylene glycols, including di- and triethylene glycol; propylene glycols, including di- and tripropylene glycol; glycerol; butanediol; hexanediol; sorbitol; arabitol; mannitol; sucrose; fructose; glucose; cyclohexanediol; trimethylolpropane erythritol; and pentaerythritols, including di- and tripentaerythritols; preferably diethylene glycol, triethylene glycol; glycerol, trimethyolpropane, sorbitol, pentaerythritol, and dipentaerythritol.

The polyhydric alcohols may be esterified with monocarboxylic acids having from 2 to about 30 carbon atoms, provided at least one hydroxyl group remains unesterified. Examples of monocarboxylic acids include acetic, propionic, butyric and the above-described fatty carboxylic acids, as well as saturated fatty acids, such as stearic, lauric and palmitic acids. Specific examples of these esterified polyhydric alcohols include sorbitol oleate, including mono- and oleates, sorbitol stearates including mono- and distearates, glycerol oleates, including glycerol mono-, di- and trioleate, and erythritol octanoates.

The hydroxy compounds may also be polyoxyalkylene polyols. The polyoxyalkylene polyols include polyoxyalkylene glycols. The polyoxyalkylene glycols may be polyoxyethylene glycols or polyoxypropylene glycols. Useful polyoxyethylene glycols are available from Union Carbide under the trade name Carbowax® PEG 300, 600, 1000 and 1450. The polyoxyalkylene glycols are preferably polyoxypropylene glycols where the oxypropylene units are at least 80% of the total. The remaining 20% may be ethylene oxide or butylene oxide. Useful polyoxypropylene glycols are available from Union Carbide under the trade name NIAX 425; and NIAX 1025. Useful polyoxypropylene glycols are available from Dow Chemical and sold by the trade name PPG-1200, and PPG-2000.

Representative of other useful polyoxyalkylene polyols are the liquid polyols available from Wyandotte Chemicals Company under the name PLURONIC Polyols and other similar polyols. These PLURONIC Polyols correspond to the formula $$HO-(CH_2CH_2O)_x(\underset{\underset{CH_3}{|}}{C}HCH_2O)_y(CH_2CH_2O)_z-H$$

wherein x, y, and z are integers greater than 1 such that the $-CH_2CH_2O-$ groups comprise from about 10% to about 15% by weight of the total molecular weight of the glycol, the average molecular weight of said polyols being from about 2500 to about 4500. This type of polyol can be prepared by reacting propylene glycol with propylene oxide and then with ethylene oxide.

In another embodiment the hydroxy-compound is an alkyl-terminated polyoxyalkylene polyol. A variety of alkyl-terminated polyoxyalkylene polyols are known in the art, and many are available commercially. The alkyl-terminated polyoxyalkylene polyols are produced generally by treating an aliphatic alcohol with an excess of an alkylene oxide such as ethylene oxide or propylene oxide. For example, from about 6 to about 40 moles of ethylene oxide or propylene oxide may be condensed with the aliphatic alcohol, such as methanol, ethanol, butanol, or fatty alcohols (i.e., those containing 8 to about 30 carbon atoms).

The alkyl-terminated polyoxyalkylene polyols useful in the present invention are available commercially under such trade names as "TRITON®" from Rohm & Haas Company, "Carbowax®" and "TERGITOL®" from Union Carbide, "ALFONIC®" from Conoco Chemicals Company, and "NEODOL®" from Shell Chemical Company. The TRITON® materials are identified generally as polyethoxylated alcohols or phenols. The TERGITOLS® are identified as polyethylene glycol ethers of primary or secondary alcohols; the ALFONIC® materials are identified as ethoxylated linear alcohols which may be represented by the general structural formula $$CH_3(CH_2)_dCH_2(OCH_2CH_2)_eOH$$

wherein d varies between 4 and 16 and e is a number between about 3 and 11. Specific examples of ALFONIC® ethoxylates characterized by the above formula include ALFONIC® 1012-60 wherein d is about 8 to 10 and e is an average of about 5 to 6; ALFONIC® 1214-70 wherein d is about 10–12 and e is an average of about 10 to about 11; ALFONIC® 1412-60 wherein d is from 10–12 and e is an average of about 7; and ALFONIC® 1218-70 wherein d is about 10–16 and e is an average of about 10 to about 11.

The Carbowax® methoxy polyethylene glycols are linear ethoxylated polymer of methanol. Examples of these materials include Carbowax® methoxy polyethylene glycol 350, 550 and 750, wherein the numerical value approximates molecular weight.

The NEODOL® ethoxylates are ethoxylated alcohols wherein the alcohols are a mixture of alcohols containing from 12 to about 15 carbon atoms, and the alcohols are partially branched chain primary alcohols. The ethoxylates are obtained by reacting the alcohols with an excess of ethylene oxide such as from about 3 to about 12 or more moles of ethylene oxide per mole of alcohol. For example, NEODOL® ethoxylate 23-6.5 is a partially branched chain alcoholate of 12 to 13 carbon atoms with an average of about 6 to about 7 ethoxy units.

In another embodiment, the hydroxy compound is a hydroxyamine. The hydroxyamine may be an alkanolamine or a polyoxyalkylated amine. The hydroxyamine may be primary, secondary or tertiary alkanol amines or mixtures thereof. Such amines may be represented by the formulae:

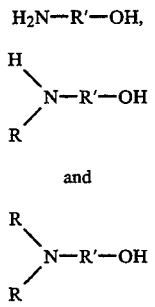

wherein each R is independently a hydrocarbyl group of one to about eight carbon atoms or hydroxyhydrocarbyl group of two to about eight carbon atoms and R′ is a divalent hydrocarbyl group of about two to about 18 carbon atoms. The group —R′—OH in such formulae represents the hydroxyhydrocarbyl group. R′ can be an acyclic, alicyclic or aromatic group. Typically, R′ is an acyclic straight or branched alkylene group such as an ethylene, 1,2-propylene, 1,2-butylene, or 1,2-octadecylene group, more preferably an ethylene or propylene group, more preferably an ethylene group. Where two R groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperazines, -piperidines, -oxazolidines, -thiazolidines and the like. Typically, however, each R is independently a methyl, ethyl, propyl, butyl, pentyl, or hexyl group. Examples of alkanolamines include monoethanol amine, diethanol amine, triethanol amine, diethylethanol amine, ethylethanol amine, butyldiethanol amine, etc.

The hydroxyamines can also be an ether N-(hydroxyhydrocarbyl)amine. These are hydroxypoly(hydrocarbyloxy) analogs of the above-described alkanolamines (these analogs also include hydroxyl-substituted oxyalkylene analogs). Such N-(hydroxyhydrocarbyl) amines can be conveniently prepared by reaction of epoxides with afore-described amines and can be represented by the formulae:

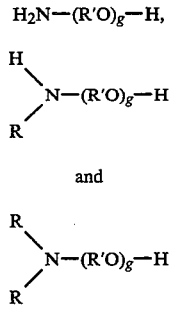

wherein g is a number from about 2 to about 15 and R and R′ are as described above. R may also be a hydroxypoly(hydrocarbyloxy) group.

In another embodiment, the hydroxy compound is a hydroxyamine, which can be represented by the formula

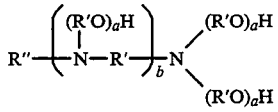

wherein each R′ is described above, R″ is a hydrocarbyl group; each a is independently an integer from zero to 100, provided at least one a is an integer greater than zero; and b is zero or one.

Preferably, R″ is a hydrocarbyl group having from 8 to about 30 carbon atoms, preferably 8 to about 24, more preferably 10 to about 18 carbon atoms. R″ is preferably an alkyl or alkenyl group, more preferably an alkenyl group. R′ is preferably an octyl, decyl, dodecyl, tridecyl, tetradecyl, hexadecyl, octadecyl, oleyl, soya or tallow group.

a is preferably 1 to about 100, more preferably 2 to about 50, more preferably 2 to about 20, more preferably 3 to about 10, more preferably about 5.

The above hydroxyamines can be prepared by techniques well known in the art, and many such hydroxyamines are commercially available. They may be prepared, for example, by reaction of primary amines containing at least 6 carbon atoms with various amounts of alkylene oxides such as ethylene oxide, propylene oxide, etc. The primary amines may be single amines or mixtures of amines such as obtained by the hydrolysis of fatty oils such as tallow oils, sperm oils, coconut oils, etc. Specific examples of fatty acid amines containing from about 8 to about 30 carbon atoms include saturated as well as unsaturated aliphatic amines such as octyl amine, decyl amine, lauryl amine, stearyl amine, oleyl amine, myristyl amine, palmityl amine, dodecyl amine, and octadecyl amine.

The useful hydroxyamines where b in the above formula is zero include 2-hydroxyethylhexylamine, 2-hydroxyethyloctylamine, 2-hydroxyethylpentadecylamine, 2-hydroxyethyloleylamine, 2-hydroxyethylsoyamine, bis(2-hydroxyethyl)hexylamine, bis(2-hydroxyethyl)oleylamine, and mixtures thereof. Also included are the comparable members wherein in the above formula at least one a is an integer greater than 2, as for example, 2-hydroxyethoxyethylhexylamine.

A number of hydroxyamines wherein b is zero are available from the Armak Chemical Division of Akzona, Inc., Chicago, Illinois, under the general trade designation "Ethomeen" and "Propomeen". Specific examples of such products include "Ethomeen C/15" which is an ethylene oxide condensate of a cocoamine containing about 5 moles of ethylene oxide; "Ethomeen C/20" and "C/25" which also are ethylene oxide condensation products from cocoamine containing about 10 and 15 moles of ethylene oxide respectively; "Ethomeen 0/12" which is an ethylene oxide condensation product of oleylamine containing about 2 moles of ethylene oxide per mole of amine. "Ethomeen S/15" and "S/20" which are ethylene oxide condensation products with soyaamine containing about 5 and 10 moles of ethylene oxide per mole of amine respectively; and "Ethomeen T/12, T/15" and "T/25" which are ethylene oxide condensation products of tallowamine containing about 2, 5 and 15 moles of ethylene oxide per mole of amine respectively. "Propomeen 0/12" is the condensation product of one mole of oleyl amine with 2 moles propylene oxide. Preferably, the salt is formed from Ethomeen C/15 or S/15 or mixtures thereof.

Commercially available examples of hydroxyamines where b is 1 include "Ethoduomeen T/13", "T/20" and "T/25" which are ethylene oxide condensation products of N-tallow trimethylene diamine containing 3, 10 and 15 moles of ethylene oxide per mole of diamine, respectively.

Another group of hydroxyamines above are the commercially available liquid TETRONIC polyols sold by Wyandotte Chemicals Corporation. These polyols are represented by the general formula:

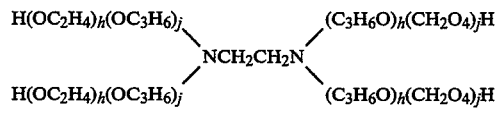

wherein h and j are such that h is a number sufficient to provide a number average molecular weight of about 3000 to about 12000, preferably to about 6000, and j is a number sufficient to provide a number average molecular weight of about 25 to about 85. Examples of these alcohols include Tetronic ® 701,901, 1501, 90R1, and 150R1 polyols. Such hydroxyamines are described in U.S. patent No. 2,979,528 which is incorporated herein by reference. A specific example would be such a hydroxyamine having an average molecular weight of about 8000 wherein the ethyleneoxy groups account for 7.5%–12% by weight of the total molecular weight. Such hydroxyamines can be prepared by reacting an alkylenediamine such as ethylene diamine, propylenediamine, hexamethylenediamine, etc., with propylene oxide. Then the resulting product is reacted with ethylene oxide.

In another embodiment, the hydroxy compound may be a propoxylated hydrazine. Propoxylated hydrazines are available commercially under the tradename Oxypruf TM. Examples of propoxylated hydrazines include Oxypruf TM 6, 12 and 20 which are hydrazine treated with 6, 12 and 20 moles of propylene oxide, respectively.

In another embodiment, the hydroxy compound may be a polyoxyalkylated phenol. The phenol may be substituted or unsubstituted. A preferred polyoxyalkylated phenol is a polyoxyethylated nonylphenol. Polyoxyalkylated phenols are available commercially from Rohn and Haas Co. under the tradename Triton ® and Texaco Chemical Company under the tradename Surfonic ®. Examples of polyoxyalkylated phenols include Triton ® AG-98, N series, and X series polyoxyethylated nonylphenols.

In another embodiment, the hydroxy compound may be a polyoxyalkylene fatty ester. Polyoxyalkylene fatty esters may be prepared from any polyoxyalkylene polyol and a fatty acid. Preferably, the polyoxyalkylene polyol is any disclosed herein. The fatty acid is preferably one of the fatty monocarboxylic acid described above. Polyoxyalkylene fatty esters are available commercially from Armak Company under the tradename Ethofat TM. Specific examples of polyoxyalkylene fatty esters include Ethofat TM C/15 and C/25, which are coco fatty esters formed using 5 and 15 moles, respectively, of ethylene oxide; Ethofat TM 0/15 and 0/20, which are oleic esters formed using 5 and 10 moles of ethylene oxide; and Ethofat 60/15, 60/20 and 60/25 which are stearic esters formed with 5, 10 and 15 moles of ethylene oxide respectively.

In another embodiment, the hydroxy compound may also be a polyoxyalkylated fatty amide. Preferably the fatty amide is polyoxypropylated or polyoxyethylated, more preferably polyoxyethylated. Examples of fatty acids which may be polyoxyalkylated include oleylamide, stearylamide, tallowamide, soyaamide, cocoamid, and laurylamide. Polyoxyalkylated fatty amides are available commercially from Armak Company under the trade name Ethomid ® and from Lonza, Inc., under the tradename Unamide ®. Specific examples of these polyoxyalkylated fatty amides include Ethomid ® HT/15 and HT/60, which are hydrogenated tallow acid amides treated with 5 and 50 moles of ethylene oxide respectively; Ethomid ® 0/15, which is an oleic amid treated with 5 moles of ethylene oxide; Unamide ® C-2 and C-5, which are cocamides treated with 2 and 5 moles of ethylene oxide, respectively; and Unamide ® L-2 and L-5, which are lauramides treated with 2 and 5 moles of ethylene oxide, respectively.

The ester-acids of the present invention may be prepared from a hydroxyl-containing compound and a carboxylic acylating agent by conventional esterification techniques. The reaction occurs between about ambient temperature and the decomposition temperature of any of the reactants or the reaction mixture, more preferably about 50° C. to 250° C., more preferably about 70° C. to 175° C. The hydroxyl compound and carboxylic acid or anhydride are reacted at an equivalent ratio from, preferably about (1:1.5–4), more preferably (1:2). When a carboxylic anhydride is used, the ester-acid is formed by a ring opening reaction between the hydroxyl compound and the anhydride.

Salts of the above ester-acids may also be used in the present invention. Salts of the above ester-acids may be ammonium or metal salts. The metal of the metal salt may be an alkali metal, alkaline earth metal or transition metal, preferably an alkali metal, or an alkaline earth metal, more preferably an alkali metal. Specific examples of metal include sodium, potassium, calcium, magnesium, zinc or aluminum, more preferably sodium or potassium. The metal cations are formed by treating an ester-acid with a metal oxide, hydroxide, carbonate, phosphate, sulfate, or halide. The metal salt is formed between ambient temperature and about 120° C., more preferably room temperature to about 80° C.

The ammonium salt may be derived from ammonia or any amine. The ammonium cation may be derived from any of the amines described herein. The ammonium cation may be derived from the hydroxyamine forming the ester, and is therefore an internal salt. Preferably, the salt is formed from alkyl monoamines, or hydroxyamines. The hydroxyamines are described above. Preferably the amine which forms the ester-salt is represented by the formula wherein R′, R″, a and b are defined above.

The alkyl monoamines are primary secondary or tertiary monoamines. The alkyl monoamines generally contain from 1 to about 24 carbon atoms in each alkyl group, preferably from 1 to about 12, and more preferably from 1 to about 6. Examples of monoamines useful in the present invention include methylamine, ethylamine, propylamine, butylamine, octylamine, and dodecylamine. Examples of secondary amines include dimethylamine, dipropylamine, dibutylamine, N-methyl,N-butylamine, N-ethyl,N-hexylamine, etc. Tertiary amines include trimethylamine, tributylamine, methyldiethylamine, ethyldibutylamine, etc.

In one embodiment, the ester-acid and ester-salt are represented by the formula

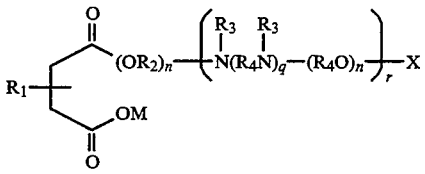

wherein $R_1$ is a hydrocarbyl group as defined above for the hydrocarbyl-substituted succinic acylating agent; $R_2$ is a hydrocarbylene group, or a hydroxy substituted or hydroxyalkyl substituted hydrocarbylene; each $R_3$ is independently hydrogen, an alkyl group, a hydroxyalkyl group, a hydrocarbylcarbonyl or a polyoxyalkylene group; each $R_4$ is independently a hydrocarbylene group; each n is independently 1 to 150; q is zero or one; r is zero or one; M is a hydrogen, an ammonium cation or a metal cation, and when r is zero, X is —H, —OAr, —OH, $—OR_5$, $—OCR_6$, $—N(R_3)_2$, $—N(R_7)—C(=O)—R_6$ or

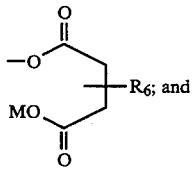

$R_6$; and $—C(=O)—R_6$, or

-continued

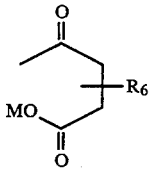

wherein each $R_5$ and $R_6$ is independently a hydrocarbyl group having up to 100 carbon atoms; $R_7$ is hydrogen or an alkyl group having from 1 to about 8 carbon atoms and Ar is a phenyl or a benzyl group.

Each $R_5$ and $R_6$ is independently a hydrocarbyl group having up to about 100 carbon atoms, preferably 2, preferably about 8 to about 50, preferably to about 30, more preferably to about 24. In one embodiment, each $R_5$ is independently an alkyl or alkenyl group. Generally, $R_5$ contains from 1 to about 28 carbon atoms, preferably to about 18, more preferably to about 12.

In another embodiment, each $R_6$ is independently an alkyl or alkenyl group, a polyalkene group, or mixtures thereof. In another embodiment, $R_6$ is a group defined the same as $R_1$.

Ar is a phenyl, naphthyl or benzyl group. The phenyl, naphthyl or benzyl group may be substituted with a hydrocarbyl group or a polyoxyalkylenyl group. The hydrocarbyl group may contain 2 to about 18 carbon atoms, more preferably about 6 to about 12, more preferably about 9. The polyoxyalkylenyl group is preferably a polyoxyethenyl or polyoxypropenyl group.

$R_2$ is a hydrocarbylene, or a hydroxy substituted or hydroxyalkyl substituted hydrocarbylene. Preferably $R_2$ is an alkylene group having from 2 to about 8 carbon atoms, more preferably 2 to about 4; or hydroxy substituted or hydroxyalkyl substituted alkylene having from 2 to about 10 carbon atoms, more preferably about 4 to about 6 carbon atoms. When $R_2$ is an alkylene group, it is preferably an ethylene or propylene group.

Each $R_3$ is independently hydrogen, an alkyl group, a hydrocarbylcarbonyl group or a polyoxyalkylene group. Preferably each $R_3$ is independently a hydrogen; an alkyl group having from 1 to about 20 carbon atoms, more preferably 1 to about 8; a hydroxy alkyl group having from 1 to about 8 carbon atoms, more preferably from 1 to about 4; a hydrocarbyl carbonyl group having from 1 to about 28 carbon atoms in the hydrocarbyl group, more preferably about 8 to about 30, more preferably about 8 to about 24; or a polyoxyethylene group, a polyoxypropylene group, or mixtures thereof, more preferably polyoxyethylene group.

In one embodiment each $R_3$ is independently an alkyl or alkenyl carbonyl group. The alkyl or alkenyl group is preferably a methyl, ethyl, propyl, butyl, hexyl, octyl, decyl, dodecyl, tetradecyl, hexadecyl, octadecyl, decenyl, dodecenyl, tetradecenyl, hexadecenyl, or octadecenyl group.

In another embodiment, each $R_3$ is independently an alkyl or alkenyl group. The alkyl or alkenyl group is preferably an ethyl, propyl, butyl, hexyl, octyl, decyl, dodecyl, tridecyl, tetradecyl, hexadecyl, octadecyl, oleyl, tallow or soya group.

In another embodiment, each $R_3$ is independently a hydroxyalkyl group. Preferably the hydroxyalkyl group is a hydroxymethyl or hydroxyethyl group, more preferably hydroxyethyl.

Each $R_4$ is independently a hydrocarbylene group. Preferably each $R_4$ is independently an alkylene group having from 1 to about 8, more preferably 2 to about 4 carbon atoms. Preferably, each $R_4$ is independently ethylene or propylene.

$R_7$ is hydrogen or an alkyl group having from 1 to about 8 carbon atoms. Preferably $R_7$ is hydrogen or a methyl, ethyl, propyl, butyl or hexyl group, more preferably hydrogen or methyl group, more preferably hydrogen.

Each n is independently 1 to about 150. Preferably each n is independently 1, more preferably 2, more preferably about 3 to about 50, more preferably to about 20, more preferably to about 10.

In one embodiment, q equals zero or one, r equals zero or one. In one embodiment, r equals zero and X is preferably —OH, —$OR_5$,

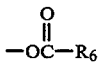

or

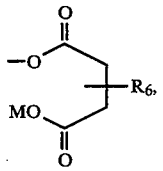

more preferably

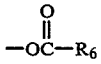

or

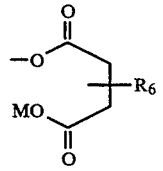

wherein $R_1$, $R_5$, $R_6$, and M are as defined previously.

In another embodiment, r equals one, q equals one and X is preferably

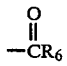

or

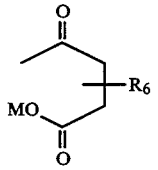

wherein $R_1$, $R_6$, and M are as defined previously.

In another embodiment, r equals zero, n equals one, $R_2$ is a hydroxy substituted or hydroxyalkyl substituted hydrocarbylene group and X is preferably —OH, —$OR_5$

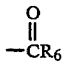

or

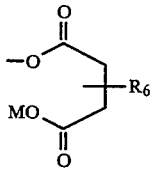

wherein $R_1$, $R_5$, $R_6$, and M are as defined previously.

The amidic-acids, and amidic-salts used in the present invention are prepared by the reaction of the above-described polycarboxylic acylating agents with at least one amine selected from the group consisting of a secondary amine, an amine-terminated polyoxyalkylene and a tertiary aliphatic primary amine. The amines are selected so that an amidic acid is formed between the amine and polycarboxylic acid.

In one embodiment, the amine is a secondary amine. The secondary amine is preferably a secondary cycloalkyl or alkyl amine. Each alkyl group independently has from 1, preferably about 3 to about 28, preferably to about 12, more preferably to about 6 carbon atoms. Each cycloalkyl group independently contains from 4 to about 28, preferably to about 12, more preferably to about 8 carbon atoms. Examples of cycloalkyl and alkyl groups include methyl, ethyl, propyl, butyl, amyl, hexyl, heptyl, octyl, cyclopentyl, cyclohexyl, cycloheptyl or cyclooctyl groups. Preferred secondary alkyl amines include but are not limited to dipropyl amine, dibutyl amine, diamyl amine, dicyclohexylamine and dihexylamine.

The amine-terminated polyoxyalkylene and tertiary alkyl primary amine are primary amines which contain a secondary or tertiary carbon atom adjacent to the nitrogen. The substituted carbon atom adjacent to the nitrogen provides stearic hindrance which impedes imide formation.

In one embodiment, the primary amine is a tertiary-alkyl primary amine. In one embodiment, the alkyl group contains from about 4, preferably about 6, more preferably about 8 to about 30, preferably to about 24 carbon atoms. Usually the tertiary alkyl primary amines are monoamines represented by the formula

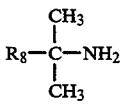

wherein $R_8$ is a hydrocarbyl group containing from one to about 27 carbon atoms. Such amines are illustrated by tertiary-butyl amine, tertiary-hexyl amine, 1-methyl-1-amino-cyclohexane, tertiary-octyl amine, tertiary-decyl amine, tertiary-dodecyl amine, tertiary-tetradecyl amine, tertiary-hexadecyl amine, tertiary-octadecyl amine, tertiary-tetracosanyl amine, tertiary-octacosanyl amine.

Mixtures of amines are also useful for the purposes of this invention. Illustrative of amine mixtures of this type are "Primene 81R" which is a mixture of $C_{11}$–$C_{14}$ tertiary alkyl primary amines and "Primene JMT" which is a similar mixture of $C_{18}$–$C_{22}$ tertiary alkyl primary amines (both are available from Rohm and Haas Company). The tertiary alkyl primary amines and methods for their preparation are known to those of ordinary skill in the art. The tertiary alkyl primary amine useful for the purposes of this invention and methods for their preparation are described in U.S. Pat. 2,945,749 which is hereby incorporated by reference for its teaching in this regard.

In another embodiment the primary amine is amine-terminated polyoxyalkylene; such as an amino polyoxypropylene-polyoxyethylene-polyoxypropylene, or an amino polyoxypropylene. These amines are generally prepared by the reaction of a monohydric alcohol with an epoxide, such as styrene oxide, 1,2-butene oxide, ethylene oxide, propylene oxide and the like, more preferably ethylene oxide, propylene oxide or mixtures thereof. The terminal hydroxyl group is then converted to an amino group. These amines are represented by the structure:

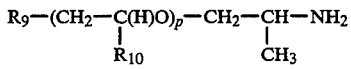

wherein p is 1 to about 150, $R_9$ is an alkoxy group having 1 to about 18 carbon atoms, and each $R_{10}$ is independently hydrogen or an alkyl group. Preferably p is 1 to 100, more preferably about 4 to about 40. Preferably each $R_{10}$ is independently hydrogen or an alkyl group having from 1 to 4 carbon atoms, more preferably hydrogen or a methyl group. $R_9$ is preferably an alkoxy group having from 1 to 12 carbon atoms, more preferably a methoxy group. These types of amines are available from Texaco Chemical Company under the tradename Jeffamine. Specific examples of these amines include Jeffamine® M-600; M-1000, M-2005 and M-2070 amines.

In another embodiment, the amine-terminated polyoxyalkylene is a diamine such as preferably amine terminated polypropylene glycols. These diamines are represented by the formula

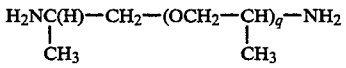

wherein q is from 1, preferably 2 to about 150, more preferably to about 100, more preferably to about 75. Examples of these amines include Jeffamine® D-230 wherein q is about 2–3;, Jeffamine® D-400 wherein q is about 5–6, Jeffamine® D-2000 wherein q is an average of about 33, and Jeffamine® D-4000 wherein q is an average of about 68.

In another embodiment, the diamines are represented by the formula

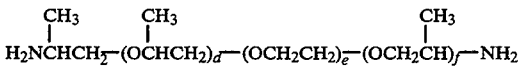

wherein d is a number in the range of from zero to about 200; e is a number in the range of form about 10 to about 650; and f is a number in the range of from zero to about 200. These diamines preferably have number average molecular weights in the range of about 600 to about 6,000, more preferably about 600 to about 2,000. Specific examples of the diamines include Jeffamine® ED-600 wherein d+f is approximately 2.5 and e is approximately 8.5; Jeffamine® ED-900 wherein d+f is approximately 2.5 and e is approximately 15.5; and Jeffamine® ED-2001 wherein d+f is approximately 2.5 and e is approximately 40.5.

In another embodiment, the diamines are represented by the formula

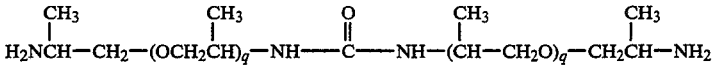

wherein q is a number sufficient to provide said compound with a number average molecular weight of at least about 600. These compounds preferably have number average molecular weights in the range of about 600, more preferably to about 2,500, more preferably to about 2,200.

In another embodiment, the amine-terminated polyoxyalkylene is a triamine prepared by treating a triol with ethylene oxide, propylene oxide, or mixtures thereof, followed by amination of the terminal hydroxyl group. These amines are available commercially from Texaco Chemical Company under the tradename Jeffamine® triamines. Examples of these amines include, Jeffamine® T-403, which is trimethylolpropane treated with about 5–6 moles of propylene oxide, Jeffamine® T-3000, which is glycerine treated with 50 moles of propylene oxide, and Jeffamine® T-5000, which is glycerine treated with 85 moles of propylene oxide.

The diamines and triamines that are useful in accordance with the present invention are disclosed in U.S. Pat. Nos. 3,021,232; 3,108,011; 4,444,566; and Re. 31,522. The disclosures of these patents are incorporated herein by reference.

The above amines are reacted with the above polycarboxylic acid to form the amidic acids of the present invention. The process for preparing the amidic acids involves reacting the polycarboxylic acids with an amine at a equivalent ratio of about (2–4:1), more preferably (2:1), at room temperature to just below the temperature of imide formation, more preferably room temperature to 150° C. more preferably room temperature to 135° C. The reaction is usually accomplished within four hours, more preferably between 0.25 to about 2 hours.

In one embodiment, the amidic-acids and amidic-salts are represented by the formulae

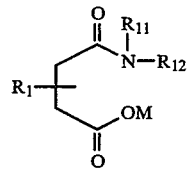

I or

-continued

II

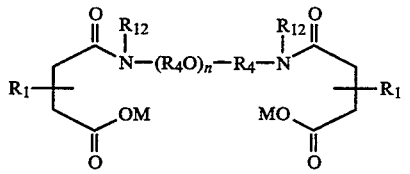

wherein each $R_1$ and $R_4$ is defined above; each $R_{12}$ is independently hydrogen, an alkyl group or polyoxyalkylene group; $R_{11}$ is an alkyl group or polyoxyalkylene group; n is 1 to about 150; and M is a hydrogen, an ammonium cation or a metal cation.

Preferably $R_{11}$ is an alkyl group, or a polyoxyalkylene group. When $R_{11}$ is an alkyl group, it is defined the same as $R_{12}$. When $R_{11}$ is a polyoxyalkylene group, it is preferably a polyoxypropylene group or a polyoxypropylene-polyoxyethylene-polyoxypropylene group.

Preferably each $R_2$ is independently a hydrogen or an alkyl group having from 1 to about 20 carbon atoms, more preferably to about 8. In a preferred embodiment, each $R_{12}$ is independently an alkyl group having from 1 to about 8 carbon atoms. Preferably each $R_2$ is independently a methyl, ethyl, propyl, butyl or amyl group, more preferably a butyl or amyl group.

In another embodiment, the amidic-acid or amidic-salt is represented by Formula I, and $R_2$ is hydrogen and $R_{11}$ is a group having a tertiary carbon atom adjacent to the amino group. Preferably, $R_{11}$ is a tertiary aliphatic group having from about 4, preferably 6, more preferably 8 to about 28, preferably about 24 carbon atoms. Preferably, $R_{11}$ is a tert-octyl, tert-dodecyl, tert- tetradecyl, tert-hexadecyl, or tert-octadecyl group.

In another embodiment, the amidic-acid or amidic-salt is represented by Formula I wherein $R_2$ is a hydrogen and $R_{11}$ is a polyoxyalkylene group. Preferably $R_{11}$ is a polyoxypropylene group or a polyoxypropylene-polyoxyethylene-polyoxypropylene group.

In another embodiment, the amidic-acid or amidic-salt is represented by Formula II, wherein $R_{12}$ is hydrogen or a methyl group, preferably hydrogen. Preferably, each $R_4$ is independently an alkylene group having from 2 to about 8, more preferably 2 to about 4, more preferably 2 or 3 carbon atoms. Preferably, each $R_4$ is independently an ethylene or propylene group.

Preferably, each $R_4$ is independently an alkylene group having from 2 to about 8 carbon atoms, more preferably 2 to about 4. Preferably each $R_4$ is independently an ethylene or propylene group.

Preferably each n is independently 1 to about 150, more preferably 2 to about 50, more preferably 2 to about 20, more preferably from about 3 to about 10.

The following Examples relate to amidic-acids, amidic-salts, ester-acids and ester-salts of the present invention. Unless otherwise indicated in the following examples and elsewhere in the specification and claims, parts and percentages are by weight, temperature is degrees Celsius and pressure is atmospheric pressure. Neutralization number is the amount in milligrams of potassium hydroxide required to neutralize one gram of sample.

EXAMPLE 1

A reaction vessel, equipped with a mechanical stirrer and thermometer, is charged with 224 parts (0.8 mole) of tetrapropylene-substituted succinic anhydride, 72 parts (0.4 mole) of sorbitol and 20 milliliters of toluene. The reaction mixture is heated to 135° C. where 0.3 part of anhydrous sodium acetate is added to the mixture. The reaction mixture is stirred for 3.5 hours at 135° C. Toluene is removed by nitrogen blowing at 135° C. for about one-half hour. The product is a sticky amber semi-solid which has a neutralization number to phenolphthalein of 160 (theoretical 152).

An ammonium salt is prepared by adding 30 parts of the above product, 270 parts of cold tap water and 6.5 parts of concentrated ammonium hydroxide to a reaction vessel. The mixture is stirred for one-quarter hour at room temperature to produce the salt.

EXAMPLE 2

A reaction vessel, equipped with a mechanical stirrer, thermometer and nitrogen sparge, is charged with 165 parts (0.15 mole) of a polybutenyl-substituted succinic anhydride having a polybutenyl group having a number average molecular weight of about 950, and 42 parts (0.15 mole) of the succinic anhydride of Example 1. The anhydrides are stirred and heated to 90° C. where 27 parts (0.15 mole) of sorbitol, 0.25 part of anhydrous sodium acetate and 20 milliliters of toluene are added to the vessel. The mixture is heated to 140° C. and held with stirring for 4 hours under a nitrogen sparge of 0.2 standard cubic foot per hour (SCFH). The toluene is removed by nitrogen sparging at 1 SCFH at 140° C. for one-half hour. The product is a dark red-amber liquid having a neutralization number to phenolphthalein of 72.

An ammonium salt of the above product is prepared by dissolving 30 parts (0.038 equivalent) of the above product and 270 parts of tap water and 3.0 grams (0.044 equivalent) concentrated ammonium hydroxide. The mixture is stirred at room temperature for one-quarter hour to produce the salt.

EXAMPLE 3

A reaction vessel is charged with 165 parts (0.15 mole) of the polybutentyl succinic anhydride of Example 2, 42 parts (0.15 mole) of the tetrapropylene succinic anhydride of Example 1 and 45 parts (0.15 mole) of PEG-300, having approximately 300 molecular weight, available from Union Carbide Chemical Company. Then, 0.25 part of anhydrous sodium acetate and 20 milliliters of toluene are added to the reaction vessel. The mixture is heated to 140° C. and held for 3.5 hours with stirring. The toluene is removed by nitrogen blowing at 0.5 SCFH at 140° C. The product is a red-amber viscous liquid having a neutralization number to phenolphthalein of 72 (theoretical 67).

An ammonium salt of the above product is prepared by dissolving 30 parts (0.037 equivalent) of the above product in 270 parts of tap water and 3.0 parts (0.045 equivalent) of concentrated ammonium hydroxide. The mixture is stirred at room temperature for one- quarter hour to produce a salt.

EXAMPLE 4

A reaction vessel, equipped with a mechanical stirrer, a thermometer and a nitrogen inlet, is charged with 133 parts (0.5 equivalent) of the succinic anhydride of Example 1 and 150 parts (0.5 equivalent) of Carbowax 300, a polyoxyethylene glycol having approximately 300 molecular weight available from Union Carbide Chemical Co. The mixture is heated with stirring and nitrogen blowing at 0.3 SCFH to 150° C. and held for one hour. The product has a neutralization number to phenolphthalein of 103.5 .

An ammonium salt of the above product is prepared by adding 100 parts (0.19 equivalent) of the above product to 90 parts of water and 10.5 parts (0.19 equivalent) concentrated ammonium hydroxide. The mixture is stirred for one-quarter hour at room temperature. The 50% aqueous solution has a pH of 7.0–7.5.

EXAMPLE 5

A vessel, equipped with a thermometer and a stirrer, is charged with 192 parts (0.5 mole) of Ethomeen C-15 and 130 parts (0.5 mole) of the succinic anhydride of Example 1. The reaction is exothermic. The reaction mixture is then heated to 110° C. and held for 2 hours. Infrared spectrum of the product shows no anhydride absorption peaks at 1770 $CM^{-1}$ and 1840 $CM^{-1}$. The product has a neutralization number of 84 .

EXAMPLE 6

A reaction vessel is charged with 133 parts (0.5 mole) of the succinic anhydride of Example 1 and 80.5 parts (0.5 mole) of n-butyl diethanolamine. The reaction is exothermic to 80° C. The reaction mixture is heated to 110° C. and stirred for 0.5 hours.

EXAMPLE 7

A reaction vessel is charged with 166 parts (0.5 mole) of a isomerized $C_{16}$ alpha-olefin substituted succinic anhydride and 74.5 parts (0.5 mole) of triethanolamine. The mixture is stirred on a roller for one-fourth hour. The vessel is heated to 100° C. and stirred on a roller for one-fourth hour.

EXAMPLE 8

A reaction vessel is charged with 47 parts (0.05 mole) of Ethoduomeen T-25 and 26 parts (0.1 mole) of the succinic anhydride of Example 1. The mixture is heated to 110°–120° C. and held for 2 hours with stirring. The product has a neutralization number to phenolphthalein of 60 (theoretical 76).

An amine salt of the above product was made by mixing 9.4 parts (0.01 equivalent) of the above product with 3.8 parts (0.01 equivalent) of Ethomeen C-15. The product is a dark amber viscous liquid.

EXAMPLE 9

Following the procedure of Example 8, 39 parts (0.15 mole) of the succinic anhydride of Example 1 and 47 parts (0.05 mole) of Ethoduomeen T-25 are reacted to form a product which has a neutralization number to phenolphthalein of 89 (theoretical 97). An ammonium salt of the above product is prepared by mixing 6.3 parts (0.01 equivalent) of the above product with 3.8 parts (0.01 equivalent) of Ethomeen C-15.

EXAMPLE 10

Following the procedure of Example 8, 26 parts (0.1 mole) of the succinic anhydride of Example 1 and 57 parts (0.1 mole) of Ethomeen C-15 are reacted to form a product which had a neutralization number to phenolphthalein of 74 (theoretical 67). An ammonium salt of the above product is prepared by mixing 8.4 parts (0.01 equivalent) of the above product with 3.8 parts (0.01 equivalent) of Ethomeen C-15.

EXAMPLE 11

Following the procedure of Example 8, 26 parts (0.1 mole) of the succinic anhydride of Example 1 and 42 parts (0.1 mole) of Unamide C-15, a cocamide treated with 5 moles of ethylene oxide, are reacted to form a product which had the neutralization number to phenolphthalein of 89 (theoretical 82). An ammonium salt of the above product is prepared by mixing 6.3 parts (0.01 equivalent) of the above product with 3.8 parts (0.01 equivalent) of Ethomeen C-15.

EXAMPLE 12

Following the procedure of Example 8, 26 parts (0.1 mole) of the succinic anhydride of Example 1 and 58 parts (0.1 mole) of Polyethylene Glycol 400 monolaurate are reacted to give a product which has a neutralization number to phenolphthalein of 71 (theoretical 66). An ammonium salt of the above product is prepared by reacting 7.9 parts (0.01 equivalent) of the above product with 3.8 parts (0.01 equivalent) of Ethomeen C-15.

EXAMPLE 13

A reaction vessel, equipped with a stirrer, thermometer, reflux condenser and addition funnel is charged with 269 parts of tetrapropenyl-substituted succinic anhydride. Then 374 parts Primene 81R (a mixture of $C_{12-14}$ t-alkyl primary amines available commercially from Rohm & Haas Co.) are added dropwise over 3 hours. The reaction is exothermic and the temperature of the reactant increases from room temperature to about 59° C. over the course of the amine addition. Stirring is continued for an additional hour at 55° C. After cooling to 40°C. the material is filtered and collected.

EXAMPLE 14

A reaction vessel, equipped as described in Example 1, is charged with 508 parts (2.0 moles) of tetrapropenyl-substituted succinic anhydride. The succinic anhydride is heated to 95° C., and 277 parts (2.1 moles) of dibutyl amine is added dropwise over 2 hours. The reaction is maintained at 95° C. for 1 hour and cooled to room temperature. The product has 3.8% nitrogen and a neutralization number to phenolphthalein of 143.

EXAMPLE 15

A vessel, equipped as described in Example 1, is charged with 133 parts (0.5 mole) of tetrapropenyl-substituted succinic anhydride, 300 parts (0.5 mole) of Jeffamine M600, and 200 parts of xylene. The reaction mixture is heated to 135° C. under stirring. The temperature is maintained between 135° and 145° C. for 3 hours. Three and one-half milliliters of water is collected. The reaction is vacuum stripped to 135° C. and 10 millimeters of mercury. The residue is cooled to room temperature. The residue is a dark orange liquid which has 1.7% nitrogen.

EXAMPLE 16

A reaction vessel is charged with 288 parts (0.33 mole) of the product of Example 3 and 141 parts (0.33 mole) of Ethomeen C-15. The mixture is stirred for 10 minutes. The product is an orange clear liquid which has 2.2% nitrogen.

EXAMPLE 17

A reaction vessel is charged with 98 parts (0.25 mole) of the product of Example 2 and 101 parts (0.25 mole) of Ethomeen S/15. The mixture is stirred for 15 minutes. The product is an orange liquid having 3.2% nitrogen and a neutralization number to phenolphthalein of 58.2.

EXAMPLE 18

A reaction vessel is charged with 1064 parts (4.0 moles) of a tetrapropenyl-substituted succinic anhydride. Then, 640 parts (4.0 moles) of diamyl amine is added dropwise over 1.25 hours. The reaction is exothermic and the temperature rises to 57° C. from room temperature. The reaction mixture is then heated to 100° C. and held for 1.50 hours. The reaction mixture is cooled to 70° C. and 1193 parts (2.8 moles) of Ethomeen C/15 and 456 parts (0.9 moles) Ethomeen S/15 are added dropwise. The mixture is stirred for 15 minutes and an orange clear liquid product is obtained. The product has 3.28% nitrogen and a neutralization number to phenolphthalein of 67.5.

EXAMPLE 19

A reaction vessel is charged with 58 parts (0.12 mole) of an amidic-acid, prepared by reacting a tetrapropenyl succinic anhydride with a Jeffamine D-400 at a (2:1) equivalent ratio, and having a neutralization number to phenolphthalein of 119.5 and a percent nitrogen of 2.8%, and 16.1 parts (0.12 mole) of dibutylamine. The reaction mixture is heated to 50° C. and stirred for 50 minutes. The product is an orange-yellow syrup having a neutralization number to phenolphthalein of 99.5 and 4.5% nitrogen.

EXAMPLE 20

A reaction vessel is charged with 33 parts (0.13 mole) of a tetrapropenyl succinic anhydride, 140 parts (0.13 mole) of a polybutenyl succinic anhydride wherein the polybutenyl group has a number average molecular weight of about 950, and 50 parts (0.13 mole) of Jeffamine D-400. The mixture is stirred for 15 minutes. The reaction temperature rose to 80° C. The reaction mixture is heated to 100° C. for 45 minutes and stirred for 10 minutes. This intermediate product has a neutralization number to phenolphthalein of 74.2 . Ethomeen C/15 (114 parts, 0.27 mole) is added to the vessel. The reaction mixture is stirred for 15 minutes. The product has a neutralization number to phenolphthalein of 48.7 and has 2.1% nitrogen.

EXAMPLE 21

A reaction vessel, equipped as described in Example 1, is charged with 280 parts (0.25 mole) of the polyisobutenyl succinic anhydride described in Example 8. The succinic anhydride is heated to 75° C. and the 40 parts (0.25 mole) of diamyl amine are added dropwise over 1 hour and 15 minutes. The reaction mixture is heated to 105° C. and the temperature is maintained for 1¼ hours. This intermediate product has a neutralization number to phenolphthalein of 62.1. Then 162 parts (0.25 mole) of Ethomeen C/20 are added at 82° C. and the reaction mixture is stirred for 15 minutes. The product is cooled to room temperature. The product has a neutralization number to phenolphthalein of 67.1, and 1.23% nitrogen.

EXAMPLE 22

A reaction vessel is charged with 39 parts (0.1 mole) of an amidic-acid prepared from a tetrapropenyl succinic anhydride and dibutyl amine and having a neutralization acid number to phenolphthalein of 143.5. Diethanol amine (10.6 parts, 0.1 mole) is added dropwise over 2 minutes, with stirring. The reaction mixture is stirred at room temperature for 15 minutes. The product has a neutralization acid number to phenolphthalein of 111 and 5.77% nitrogen.

As described above, the mixture used to treat the polymer fabrics are composed of (i) at least one ester-acid, ester-salt or mixture thereof, and (ii) at least one amidic-acid, amidic-salt or mixtures thereof. The mixture is composed of a sufficient amount of (i) and (ii) to provide wicking and wetting properties to the polymer fabric. In one embodiment, the amidic-acid, amidic-salt or mixture thereof is present in a major amount (greater than 50% by weight of the mixture). In this embodiment, the ester-acid, ester-salt or mixture thereof is present in a minor amount (less than 50% by weight of the mixture). In another embodiment, (i) the ester-acid, ester-salt or mixture thereof is present in an amount from about 1%, preferably about 10% to about 99%, preferably about 75%, more preferably about 40%, more preferably about 30% by weight of the mixture. The amidic-acid, amidic-salt or mixture thereof is present in an amount from about 1%, preferably about 25%, more preferably about 60%, more preferably about 70% to about 99%, preferably about 95%, more preferably about 90% by weight of the mixture. A useful mixture composed of 80% by weight of an amidic-acid, amidic-salt or mixture thereof and 20% by weight of an ester-acid, ester-salt or mixtures thereof.

The polymer fabrics are generally treated with about 0.25%, preferably about 0.5%, more preferably about 0.75% up to about 5%, preferably about 3%, more preferably about 2%, more preferably about 1% by weight of the mixture in an organic or aqueous mixture. The mixture may be a solution or dispersion. The organic mixture may be prepared by using volatile organic solvents. Useful organic solvents include alcohols, such as alcohols having from 1 to about 6 carbon atoms, including butanol and hexanol; or ketones, such as acetone or methylethylketone. Preferably the wetting agents are applied as an aqueous solution or dispersion. The wetting agents may be applied either by spraying the fabric or dipping the fabric into the mixture. After application of the wetting agents, the treated fabric is dried by any ordinary drying procedure such as drying at 120° C. for approximately 3 to 5 minutes.

A cowetting agent may be used to reduce wetting time of the above aqueous mixture. The cowetting agent is preferably a surfactant, more preferably a nonionic surfactant. Useful surfactants include the above described alkyl-terminated polyoxyalkylenes, and alkoxylated phenols. Preferably, the surfactant is an alkyl-terminated polyoxyalkylene.

The wetting time of the mixture may also be reduced by heating the mixture. Usually the mixture is applied at room temperature. However, a 10°-15° C. increase in temperature significantly reduces wetting time.

Preferably, after drying the treated polymer fabrics have from about 0.1, preferably about 0.5 to about 3%, preferably to about 1%, more preferably to about 0.8% pickup based on the weight of the fabric. Percent pickup is the percentage by weight of the mixture on a polymer fabric.

The following Table I contains examples of mixtures useful in the present invention.

TABLE I

| Examples | Ester-Acid, Ester-Salt | Amidic-Acid, Amidic-Salt | Weight Ratio |
|---|---|---|---|
| A | Example 1 | Example 13 | 90:10 |
| B | Example 2 + | Example 14 | 10:90 |

TABLE I-continued

| Examples | Ester-Acid, Ester-Salt | Amidic-Acid, Amidic-Salt | Weight Ratio |
|---|---|---|---|
| | Example 3 (50:50) % weight | | |
| C | Example 4 | Example 22 | 40:60 |
| D | Example 5 | Example 17 | 50:50 |
| E | Example 6 | Example 18 | 20:80 |
| F | Example 7 | Example 20 + Example 16 (75:25) % weight | 25:75 |
| G | Example 8 | Example 21 | 5:95 |

The following Table II contains examples of polypropylene fabrics treated with aqueous solutions or dispersions of the mixture (B). The polymer fabric may be any polypropylene fabric available commercially. The aqueous solution or dispersion contains at least one of the mixtures in the amount shown in the Table. The polypropylene fabric is dipped into the aqueous solution or dispersion and then dried for 3–5 minutes at 125° C.

TABLE II

| Examples | Mixture (B) | Amount Mixture (B) In Water |
|---|---|---|
| I | Example A | 1% |
| II | Example B | 0.75% |
| III | Example C | 0.5% |
| IV | Example D | 0.75% |

The treated polymer fabrics have improved hydrophilic character. The treated fabrics show an improvement in the wicking/wetting ability of the fabrics. The polymer fabrics of the present invention may be formed into diapers, feminine products, surgical gowns, breathable clothing liners and the like by procedures known to those in the art.

The properties of the treated fabrics or products made with the fabrics may be measured by ASTM Method E 96-80, Standard Test Methods for Water Vapor Transmission of Materials, and INDA Standard Test 80 7-70 (82), INDA Standard Test for Saline Repellency of Nonwovens, often referred to as the Mason Jar Test. The latter test uses a 0.9% by weight saline solution.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

I claim:

1. An article, comprising: (A) a polymer fabric treated with (B) a composition comprising a mixture of (i) at least one ester-acid, ester-salt or mixtures thereof and (ii) at least one amidic-acid, amidic-salt or mixtures thereof.

2. The article of claim 1, wherein the polymer fabric is non-woven.

3. The article of claim 1, wherein the polymer of the polymer fabric is polypropylene.

4. The article of claim 1, wherein the composition treating said fabric comprises a mixture of (i) at least one reaction product of a hydrocarbyl-substituted succinic acylating agent and a hydroxy compound, wherein the reaction product is an ester-acid, ester-salt or mixture thereof, and (ii) at least one reaction product of a hydrocarbyl-substituted succinic acylating agent with an amine selected from the group consisting of a secondary amine, an amine-terminated polyoxyalkylene and tertiary alkyl primary amine, wherein the reaction product is an amidic-acid, amidic-salt or mixtures thereof.

5. A diaper containing article of claim 1.

* * * * *